United States Patent [19]

Stedman

[11] 4,207,967

[45] Jun. 17, 1980

[54] COMBINED LIFTING MECHANISM AND OVERHEAD GUARD FOR LIFT VEHICLES

[75] Inventor: Robert N. Stedman, Chillicothe, Ill.

[73] Assignee: Caterpillar Tractor Co., Peoria, Ill.

[21] Appl. No.: 875,829

[22] Filed: Feb. 6, 1978

Related U.S. Application Data

[63] Continuation of Ser. No. 633,349, Nov. 19, 1975, abandoned.

[51] Int. Cl.[2] ..... B66B 9/20; B66F 9/06; B66F 17/00

[52] U.S. Cl. ..... 187/9 E; 414/634; 414/914; 280/756

[58] Field of Search ..... 187/9 R, 8.71, 9 E; 296/102, 107; 280/756; 214/139, 660, 670, 671, 672, 673, 674, 778, DIG. 7; 254/124; 414/696, 630–638, 715, 662, 663

[56] References Cited

U.S. PATENT DOCUMENTS

| | | | |
|---|---|---|---|
| 2,704,615 | 3/1955 | Stokes et al. | 214/DIG. 7 |
| 3,208,556 | 9/1965 | Shaffer | 187/9 E |
| 3,454,176 | 7/1969 | Landeborg et al. | 214/778 X |
| 3,841,698 | 10/1974 | Stammen | 214/DIG. 7 |

*Primary Examiner*—Frank E. Werner
*Attorney, Agent, or Firm*—Sheldon R. Meyer

[57] ABSTRACT

A lift mechanism for lift vehicles of a type including an operator's station and a carriage arranged for vertical travel upon a mast assembly. In one embodiment, the lift mechanism includes a lever arrangement, preferably an overhead guard structure, pivotably connected to the vehicle and operatively connected with the carriage by means of a pivotable link. In other disclosed embodiments, the lever mechanism is also an overhead guard structure providing an overhead guard function for the operator station while the mast assembly preferably includes a fixed upright portion and at least one movable upright portion supporting the carriage, the movable overhead guard structure and link being operable to cause vertical travel of both the movable upright portion and carriage. An additional embodiment has the overhead guard lift the movable upright and the short lift cylinder lifts the carriage.

15 Claims, 5 Drawing Figures

18
44
58
56
54
52
50
72
74
68
70
30
16
26
12
64
14
66
60
62
10

COMBINED LIFTING MECHANISM AND OVERHEAD GUARD FOR LIFT VEHICLES

This is a continuation, of Ser. No. 633,349, filed Nov. 19, 1975, which case is now abandoned.

BACKGROUND OF THE INVENTION

The present invention relates to a material handling lift vehicle of a type including a vertical mast at one end, vertical travel of a carriage along the mast being effected by vertical movement of a lever arrangement upon the vehicle which preferably comprises an overhead guard structure for an operator station.

Many designs are known in the prior art for lift vehicles of a type generally contemplated by the present invention. In most such conventional lift vehicles, a material handling carriage is arranged for vertical travel along a vertical mast including at least a fixed upright. In many designs, a mast assembly includes one or more movable uprights which may be raised to serve as extensions for the fixed upright with the carriage being movable along the entire extended length of the mast assembly.

The most conventional arrangement for such mast assemblies includes a hydraulic jack which serves both to cause free travel of the carriage along the mast and also to shift the movable uprights into their extended positions. The movable uprights are commonly positioned by means of chains which are secured to one portion of the fixed upright and trained about sheaves on the movable uprights, operation of a single jack commonly being employed to effect both free travel of the carriage and extension of the movable uprights.

Additional lift vehicles are also known in the prior art having material handling carriages which may be freely supported by one or a pair of elongated levers arranged along the length of the vehicle. Normally, the carriage has a fixed pivotable mounting on the levers and remains connected to a movable end of the levers. It is desirable to have such carriages travel in a straight vertical line rather than along an arcuate path as would normally be provided by such a lever configuration. Accordingly, relatively complicated linkages are provided for the levers in order to compensate for its normal arcuate path and produce a more vertical straight line path of travel for the carriage. Lift vehicles of the type described immediately above may be seen for example in U.S. Pat. Nos. 2,980,271; 3,187,911; 3,198,359; 3,432,050; and 3,454,176.

However, it has been found that there remains a need for a relatively simple and effective material handling lift vehicle of a type including an operator's station with a carriage being arranged for vertical travel along a mast at one end of the vehicle.

SUMMARY OF THE INVENTION

Accordingly, it is an object of the invention to provide a material handling lift vehicle or a lifting mechanism for such a vehicle for accomplishing one or more desirable advantages of the type set forth above.

In addition, it is an object of the invention to provide such a material handling lift vehicle of a type wherein a carriage is movable along a vertical mast assembly arranged at one end of the vehicle, vertical travel of the carriage being effected by lever means pivotably connected toward the opposite end of the vehicle with a link being effectively pivoted between the carriage and an adjacent movable end of the lever.

It is a further object of the invention to provide such a material handling lift vehicle wherein the lever means also functions as an overhead guard structure above an operator station for the vehicle.

It is yet another object of the invention to provide such a material handling lift vehicle of a type wherein the mast assembly includes a fixed upright and at least one movable upright, pivotable movement of a lever means upon the vehicle serving to shift the movable uprights into an extended position relative to the fixed upright.

Within a combination of the type discussed above, it is a further object of the invention to provide such a material handling lift vehicle wherein extension of the movable uprights is effected by the lever means on the vehicle while free travel of the carriage is effected by a jack means which may thereby be of a relatively short length for improving an operator's view from the operator's station toward the carriage.

Additional objects and advantages of the invention are made apparent in the following description having reference to the accompanying drawings.

DESCRIPTION OF THE PREFERRED EMBODIMENT

It will be apparent from the preceding description of the figures that the following description will be directed toward three embodiments of a material handling lift vehicle. Common features for these vehicles include a lever arrangement upon the vehicle wherein the lever forms an overhead guard structure for an operator station on the vehicle. A vertical mast assembly is arranged upon the vehicle and includes a movable carriage.

In addition, the mast assembly for the various embodiments may also include one or more removable upright sections. In the three embodiments, movement of the movable uprights and/or the carriage may be accomplished by the pivotable overhead guard structure on the vehicle. However, it will be apparent from the following description that in the embodiment of FIGS. 1–3, the carriage is positioned in free travel by a hydraulic jack included within the mast assembly. In the FIG. 4 embodiment, extension of the movable upright portion within the mast assembly is accomplished by pivotal movement of the overhead guard structure on the vehicle. A sheave located on the inner upright has a chain trained thereover, the ends of which are fixed to the fixed upright near its top end and the carriage so that carriage movement is accomplished by movement of the movable upright relative to the fixed upright. Finally, the FIG. 5 embodiment includes a mast assembly which has only a fixed upright and no movable upright sections, free travel of a material handling carriage upon the mast assembly being accomplished by pivotal movement of a lever mechanism preferably embodied as an overhead guard structure.

Figure 1:
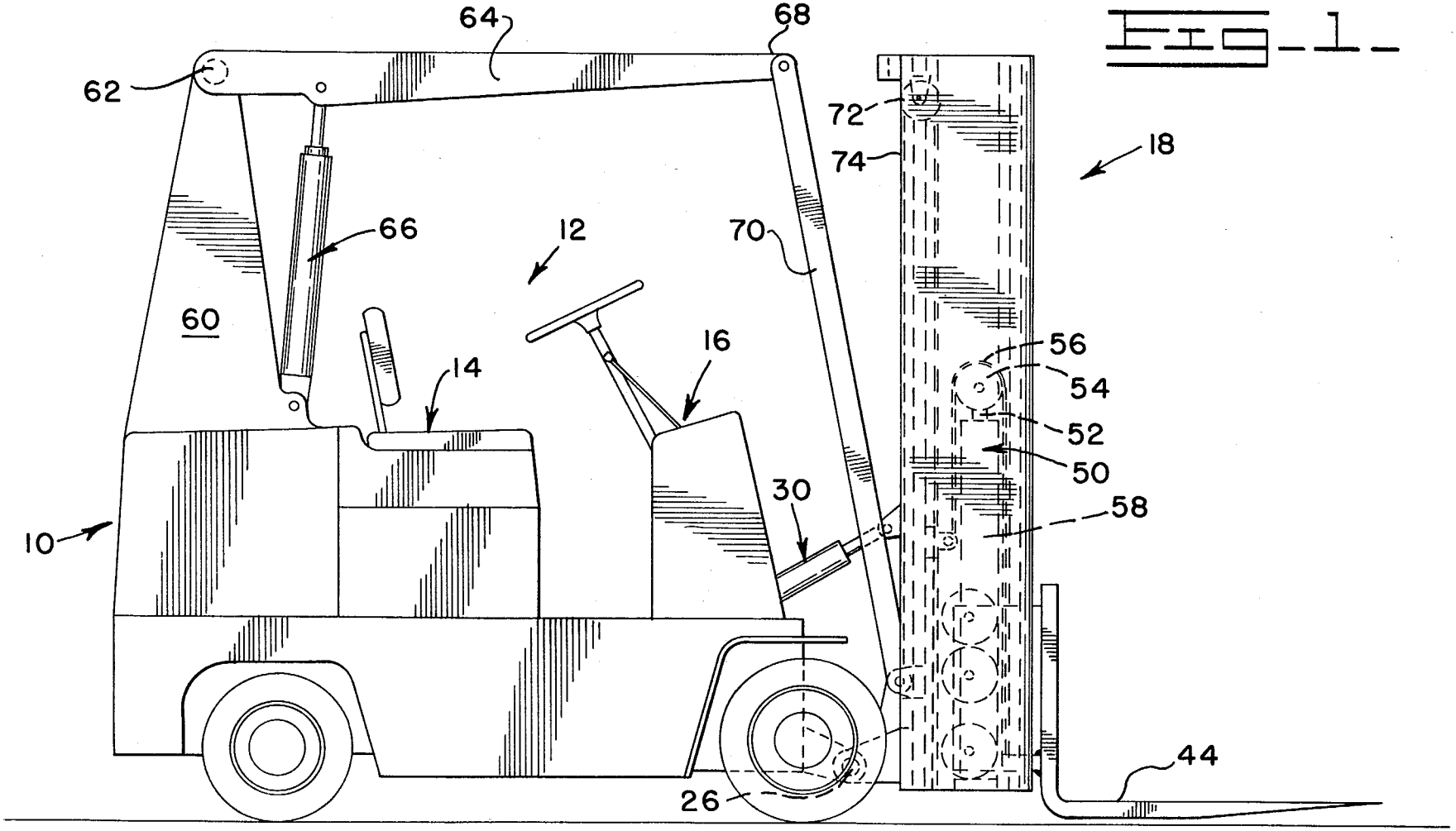
FIG. 1 is a side view in elevation of a material handling lift vehicle constructed in accordance with the present invention.
Figure 2:
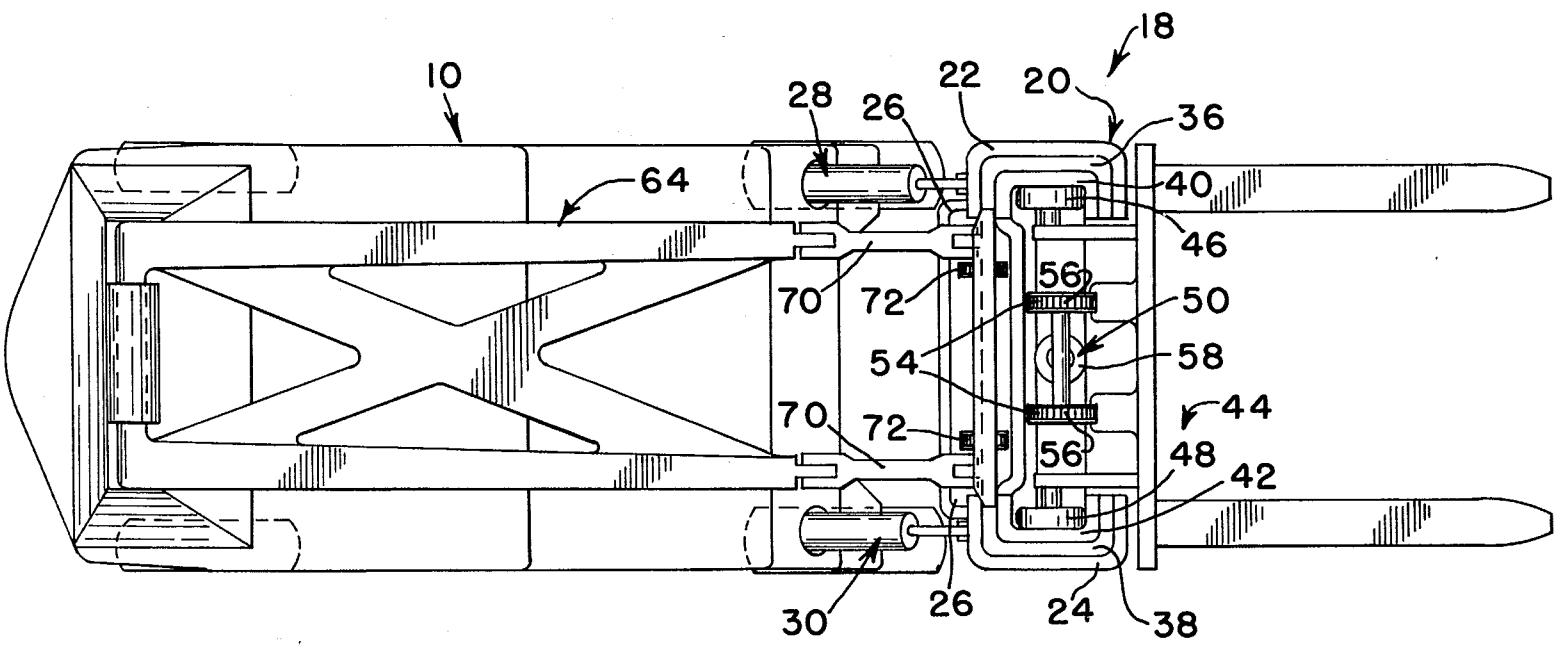
FIG. 2 is a plan view of the material handling vehicle of FIG. 1.
Figure 3:
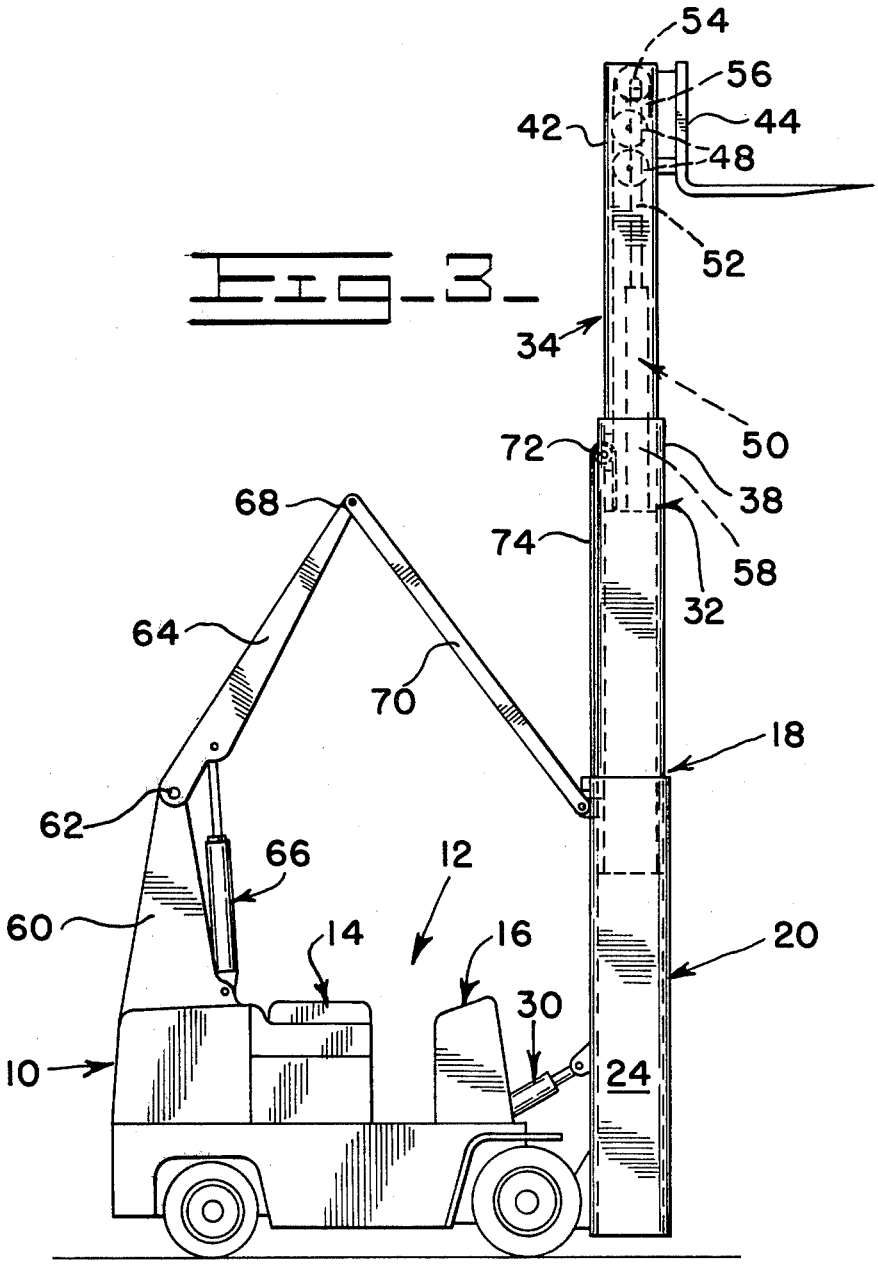
FIG. 3 is a similar side view in elevation of the material handling lift vehicle of FIGS. 1 and 2, the lift vehicle of FIG. 3 being illustrated in a condition where its carriage is raised to a maximum height along the mast assembly.

To describe these embodiments in order, reference is first made in combination to FIGS. 1–3 wherein a material handling lift vehicle is indicated at 10. The vehicle includes an operator station 12 having a seat 14 and an operating console 16.

The operator station 12 is preferably arranged upon the vehicle to afford an operator a clear view in relation with a vertical mast assembly 18. The mast assembly 18 includes a fixed upright section 20 comprising a pair of spaced apart rails 22 and 24 (see FIG. 2). The fixed upright section 20 is mounted upon the vehicle 10 by means of pivot connections indicated at 26 in FIGS. 1 and 2. Angular movement of the fixed upright section 20 and accordingly the entire mast assembly 18, in the plane of FIGS. 1 and 3, is accomplished by a pair of hydraulic jacks 28 and 30 which are interconnected between the vehicle 10 and the fixed upright section 20.

Returning to the mast assembly 18, it also includes a pair of nested, movable upright sections indicated respectively at 32 and 34 (see FIG. 3). The intermediate upright section 32 includes a pair of rails 36 and 38 which are nested immediately within the rails 22,24 of the fixed upright section 20. Similarly, the inner upright section 34 also has a pair of spaced apart rails 40 and 42 which are nested immediately within the rails 36,38 of the intermediate upright section 32. Bearing means such as rollers (not shown) are provided to facilitate relative movement of the intermediate and inner upright sections 32 and 34 relative to the fixed upright section 20.

The mast assembly 18 also includes a material handling carriage 44 which is supported upon the inner upright section 34 by means of rollers 46 and 48 which are nested within the rails 40 and 42 for the inner upright section 34.

As indicated above, free travel of the carriage 44 is achieved by means of a hydraulic jack 50 carried by the inner upright section 34. The jack 50 has an extendable rod 52 supporting sheaves 54 at its upper end. The carriage 44 is raised and lowered relative to the inner upright section 34 by means of chains 56 which are trained over the sheaves 54 and secured to a portion of the inner upright section adjacent the jack 50.

Since the jack 50 is employed only to accomplish free travel of the carriage along the length of the inner upright section 34, it is only necessary that the length of the cylinder 58 for the jack be approximately one half the height of the inner upright section. Normally for such a lift truck, the jack carried by the inner upright section would extend along substantially its full length in order to provide for extension of the movable uprights in addition to free travel of the carriage.

As discussed in greater detail below, extension of the movable uprights 32 and 34 is accomplished by different means. The shortened length of the jack contributes greatly to an improved view by the operator through the mast assembly so that he is better able to maneuver the vehicle and the carriage 44.

Extension of the movable upright section 32 and 34 is accomplished by means of a lever arrangement which also functions as an overhead guard for the operator station. Referring particularly to FIGS. 1 and 3, a tower structure 60 at the rear of the vehicle 10 provides a pivot mounting at 62 for an elongated lever arrangement 64. Referring particularly to FIG. 2, it may be seen that the lever arrangement 64 is a fabricated structure which extends over the operator station and thus serves as an overhead guard at least in its lowered position as illustrated in FIG. 1. Pivotable movement of the lever arrangement 64 is controlled by a pair of jacks (one of which is indicated at 66) interconnected between the vehicle 10 and a portion of the lever arrangement 64. The opposite end 68 of the lever arrangement extends forwardly toward the mast assembly and is pivotably interconnected with a lower portion of the intermediate upright section 32 by means of a pair of elongated links 70. Accordingly, as the lever arrangement 64 is pivoted from its lowered position in FIG. 1 toward its raised position illustrated in FIG. 3, the intermediate upright section is extended upwardly relative to the fixed upright section 20.

Movement of the inner upright section 34 is accomplished by means of a chain arrangement so that extension of the inner upright section 34 occurs simultaneously with extension of the intermediate upright section 32. The lift assembly for the inner upright section 34 includes a pair of rollers 72 mounted upon an upper portion of the intermediate upright section 32. A pair of chains 74 are secured at one end to a bottom portion of the inner upright section 34, the chains then being trained over the rollers and connected at their opposite ends to a portion of a fixed upright section 20. Accordingly, as the intermediate upright section 32 is raised by the lever 64, the inner upright section 34 is also raised by the chains 74. By additional nesting of channel sections and repeating the chain reeving, any number of masts can be extended.

Within the above arrangement, it may be seen that the lever arrangement or overhead guard structure 64 provides adequate head room for the operator station when it is in its lowered position as illustrated in FIG. 1. Referring particular to FIG. 2, it may be seen that the operator has an unusually clear view between the two elongated links 70 and over the top of the jack 50 so that he can more accurately maneuver the vehicle 10 and position the carriage 44.

Figure 4:
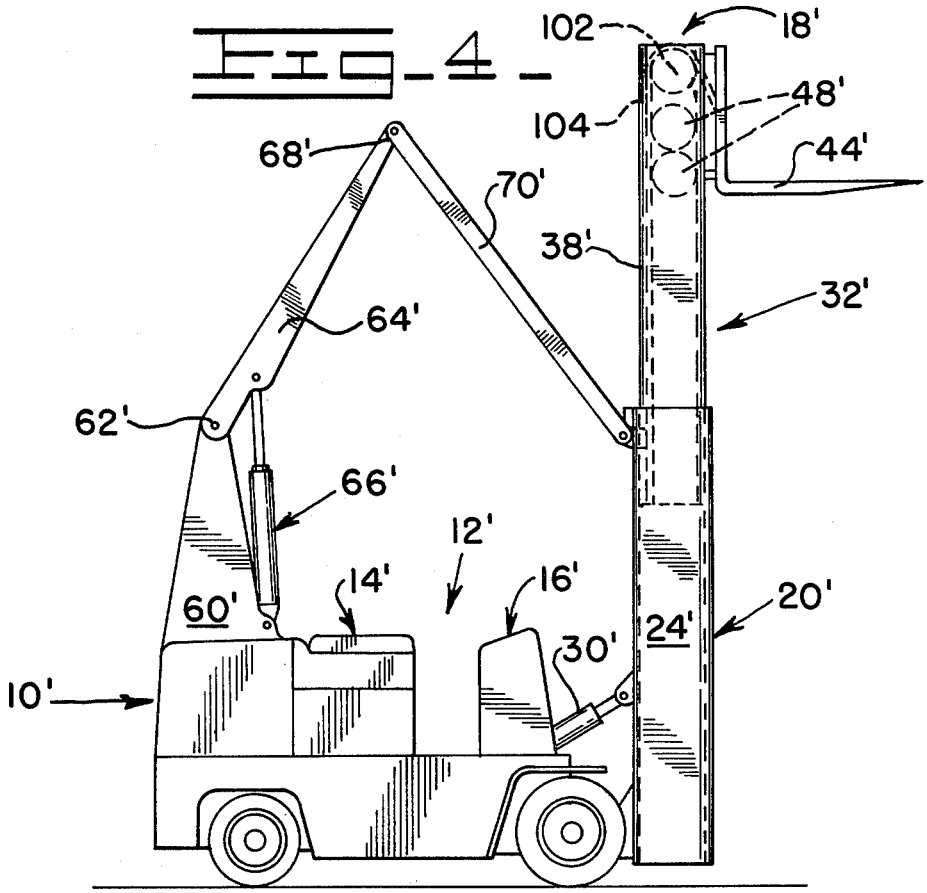
FIG. 4 is a similar side view in elevation of another embodiment of the material handling lift vehicle constructed in accordance with the present invention, movement of both the carriage and a movable upright in the mast assembly being accomplished by a lever arrangement upon the vehicle. This differs from the embodiment of FIG. 1 wherein free travel of the carriage is accomplished by a foreshortened jack included within the mast assembly.

The embodiment of FIG. 4 provides a single lift arrangement for a mast assembly upon a similar lift truck wherein the mast assembly for the vehicle 10 in FIGS. 1–3 includes a double lift arrangement. Generally, operation of the lift assembly for the embodiment of FIG. 4 is accomplished in a similar manner. However, in the FIG. 4 embodiment, there is only a single movable upright section corresponding generally to the intermediate upright section 32 of FIGS. 1–3. The carriage of FIG. 4 is arranged for movement upon that single movable upright section. Operation of the carriage is achieved through the lever arrangement together with extension of the single intermediate upright section.

Those elements of the lift vehicle of FIG. 4 which correspond with elements in the embodiment of FIGS. 1–3 are identified by similar but primed numerals.

Here again, the elongated links 70' are pivotably connected between the forward end 68' of the lever arrangement 64' and a lower portion of the single movable upright section 32'. The rollers (part of which are indicated at 48') for the carriage 44' are nested within the rails such as that indicated at 38', for the single movable upright section 32'.

Within the FIG. 4 embodiment, movement of the carriage is achieved by means of a similar chain arrangement as was employed to move the inner upright section 34 of FIG. 1. A pair of sheaves (one of which is indicated at 102) are mounted at the top of the single movable upright section 32'. A chain 104 secured at one end to the carriage 44' is trained over each of the sheaves and connected at its opposite end to a portion of the fixed upright section 20'. Accordingly, as the single movable upright section 32' is raised and lowered by means of the lever arrangement 64', the carriage 44' is also caused to be raised and lowered relative to the movable upright section 32'.

Figure 5:
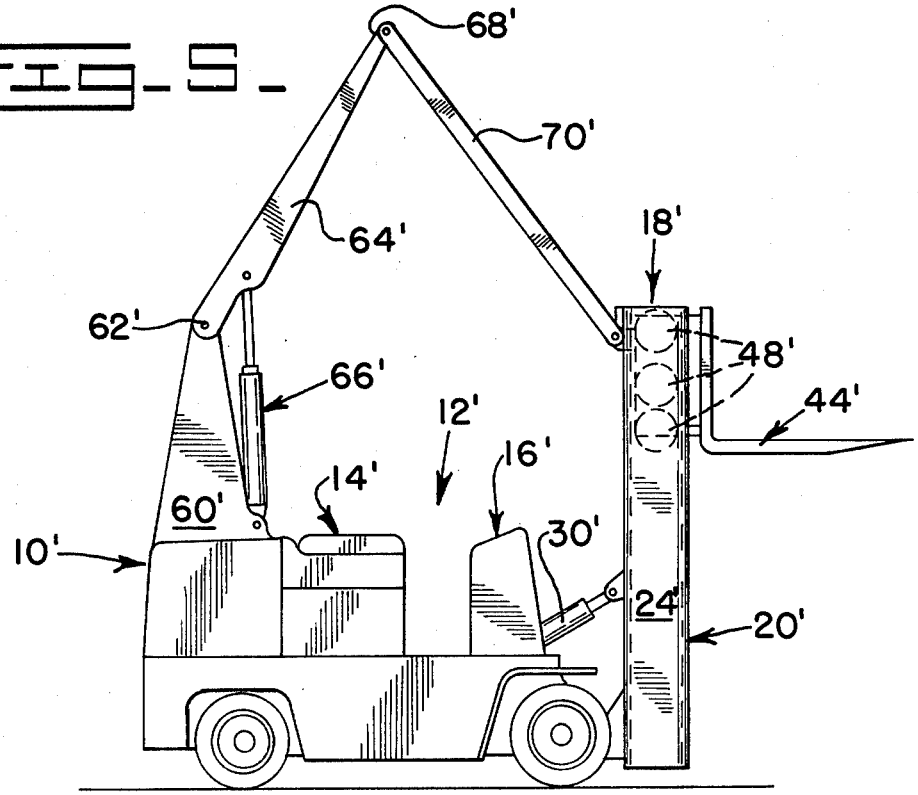
FIG. 5 is also a side view in elevation of yet another material handling lift vehicle constructed in accordance with the present invention, the mast assembly of the FIG. 5 vehicle including only a fixed upright with a carriage being movable therealong by means of a lever arrangement upon the vehicle.

The embodiment illustrated in FIG. 5 is further simplified in that its mast assembly includes only a fixed upright section and no movable upright section. Here again, portions of the lift vehicle in FIG. 5 which correspond to those described above in FIGS. 1–3 are again indicated by primed numerals.

It may be seen that the rollers for supporting the carriage 44' (a portion of which are indicated at 46') are nested within the rails 22' and 24' for the fixed upright section 20'. The elongated links 70' are connected directly with a portion of the carriage assembly 44'. Accordingly, within the embodiment of FIG. 5, pivotal movement of the lever arrangement or overhead guard structure 64 toward the elevated position illustrated in FIG. 5 serves to move the carriage upwardly along a straight vertical path provided by the fixed upright section 20'.

It will be obvious from the preceding description that other modifications are possible within the scope of the present invention as defined by the following appended claims.

What is claimed is:

1. In a lift vehicle of a type including an operator station, a vertical mast assembly arranged at one end of the vehicle, the mast assembly including a fixed upright portion and a movable upright portion, a material handling carriage being arranged for vertical travel on the movable upright portion, means interconnecting the carriage with the movable upright portion for causing vertical movement of the carriage thereupon, a combined lifting mechanism and overhead guard structure comprising an overhead guard structure extending over the operator station and pivotably connected to the vehicle toward its other end, the overhead guard structure having a movable end adjacent the mast assembly, motor means for pivoting the overhead guard structure relative to the vehicle, said motor means mounted to the overhead guard structure and said motor means mounted to the vehicle rearwardly of the mast assembly, and a link pivotably interconnected between the movable end of the overhead guard structure adjacent the mast assembly and the movable upright portion for causing vertical travel of the movable upright portion and carriage in response to pivotable movement of the overhead guard structure.

2. The lift vehicle of claim 1 wherein the vehicle includes a tower structure mounted upon a portion of the vehicle at its other end, and wherein the overhead guard structure has a pivotable connection with the tower structure, the motor means comprising at least one hydraulic jack pivotably interconnected between the vehicle and the overhead guard structure.

3. The lift vehicle of claim 1 wherein the movable upright portion comprises a first movable upright portion and a second movable upright portion, said second movable upright portion movable relative to both the fixed upright portion and the first movable upright portion, wherein said link is connected to the first movable upright portion, and including means for causing vertical movement of the second movable upright portion relative to the first movable upright portion in response to relative movement of the first movable upright portion relative to the fixed upright portion.

4. The lift vehicle of claim 3 further comprising jack means carried by the second movable upright portion for producing free travel of the carriage which is supported upon the second movable upright portion.

5. The lift vehicle of claim 1 further comprising jack means carried by the movable upright portion for producing free travel of the carriage.

6. In a lift vehicle of a type including an operator station, a vertical mast assembly arranged at one end of the vehicle and a material handling carriage movably mounted for vertical travel on the mast assembly, a combined lifting mechanism and overhead guard structure comprising an overhead guard structure extending over the operator station and being movably mounted upon the vehicle, means operatively coupling the overhead guard structure with the carriage, and motor means arranged for interaction between the overhead guard structure and vehicle, said motor means mounted to the overhead guard structure, and said motor means mounted to the vehicle between the operator station and the other end of the vehicle, the motor means being operable for moving the overhead guard structure between a first relatively lowered position with the overhead guard structure being positioned to provide adequate head room in the operator station and to serve as a protective cover for the operator station, the carriage then being in a relatively low position on the mast structure, and a second relatively elevated position above the operator station, movement of the overhead guard structure toward its second position causing the carriage to move relatively upwardly along the vertical mast assembly.

7. The lift vehicle of claim 6 wherein the means operatively coupling the overhead guard structure with the carriage comprises at least one elongated link pivotably interconnected therebetween.

8. The lift vehicle of claim 7 wherein the mast assembly comprises a fixed upright portion and at least one movable upright portion, the carriage being arranged for vertical travel upon the movable upright portion, the elongated link being pivotably connected with the movable upright portion.

9. The lift vehicle of claim 8 further comprising means for producing vertical travel of the carriage relative to the movable upright portion in response to relative movement of the movable upright portion relative to the fixed upright portion.

10. In a lift vehicle of a type including a vertical mast assembly arranged at one end of the vehicle with a material handling carriage movably mounted for vertical travel on the mast assembly, a lifting mechanism comprising an elongated lever pivotably connected adjacent the other end of the vehicle and having a vertically movable end adjacent the mast assembly, motor means interconnected between the vehicle and lever for pivoting the lever, said motor means mounted to the vehicle adjacent the other end thereof, and a link having one end pivotably connected with the movable end of the lever, the link also being operatively coupled at its other end with the carriage, the link causing the carriage to be vertically moved on the mast assembly in response to pivotable movement of the elongated lever and arcuate movement of the adjacent movable link.

11. The lift vehicle of claim 10 wherein the vehicle includes a tower structure mounted upon a portion of the vehicle at its other end, wherein the elongated lever is pivotably connected to said tower structure , the elongated lever comprising an overhead guard structure extending above an operator station for the vehicle.

12. A material handling lift machine comprising a vehicle having an operator station, a vertical mast assembly arranged at one end of the vehicle and including a fixed upright portion, a movable upright portion, a material handling carriage arranged for vertical travel on the movable upright portion, and jack means arranged upon the movable upright portion for controlling free travel of the carriage substantially along the vertical length of the movable upright portion an overhead guard structure extending over the operator station and pivotably connected toward the other end of the vehicle, motor means for pivoting the overhead guard structure relative to the vehicle, said motor means mounted to said overhead guard structure, and said motor means mounted to the vehicle between the operator station and the other end of the vehicle, and a link pivotably interconnected between a movable end of the overhead guard structure adjacent the mast assembly and the movable upright portion for causing vertical travel of the movable upright portion and carriage in response to pivotable movement of the overhead guard structure.

13. The lift vehicle of claim 1 wherein the link is connected to the bottom of the movable upright portion.

14. The lift vehicle of claim 12 wherein the link is connected to the bottom of the movable upright portion.

15. The lift vehicle of claim 6 wherein the vertical mast assembly includes a fixed upright portion and a movable upright portion, wherein movement of the overhead guard structure toward its second position causes the movable upright portion to move upwardly to a position above said second relatively elevated position of the overhead guard structure.

* * * * *